US005406295A

United States Patent [19]

Baranski et al.

[11] Patent Number: 5,406,295

[45] Date of Patent: Apr. 11, 1995

[54] WINDOW ANTENNA FOR A MOTOR VEHICLE BODY

[75] Inventors: Detlef Baranski, Recklinghausen; Peter Reichmann, Gelsenkirchen; Peter Paulus, Münster, all of Germany

[73] Assignee: Flachglas Aktiengesellschaft, Furth, Germany

[21] Appl. No.: 25,365

[22] Filed: Feb. 24, 1993

[30] Foreign Application Priority Data

Feb. 26, 1992 [DE] Germany ..... 42 05 851.1

[51] Int. Cl.[6] ..... H01Q 1/32

[52] U.S. Cl. ..... 343/713; 343/825; 343/846

[58] Field of Search ..... 343/711, 712, 713, 846, 343/847, 848, 825, 829, 830, 831; H01Q 1/32

[56] References Cited

U.S. PATENT DOCUMENTS

| | | | |
|---|---|---|---|
| 3,971,030 | 7/1976 | Sauer | 343/713 |
| 4,138,681 | 2/1979 | Davidson et al. | 343/825 |
| 4,749,998 | 6/1988 | Yotsuya | 343/713 |
| 5,128,685 | 7/1992 | Shinnai et al. | 343/713 |
| 5,220,336 | 6/1993 | Hirotsu et al. | 343/713 |
| 5,255,002 | 10/1993 | Day | 343/713 |
| 5,264,858 | 11/1993 | Shiina | 343/713 |

FOREIGN PATENT DOCUMENTS

| | | | |
|---|---|---|---|
| 3732944A1 | 4/1989 | Germany . | |
| 3824417 | 1/1990 | Germany | H01Q 1/32 |
| 62-43905 | 2/1987 | Japan . | |
| 4-132401 | 5/1992 | Japan | H01Q 1/32 |
| 4-347910 | 12/1992 | Japan | H01Q 1/32 |
| 460570 | 1/1937 | United Kingdom . | |
| WO92/02971 | 2/1992 | WIPO . | |

OTHER PUBLICATIONS

Handbuch der Physik, Band XXV/I, Berlin, pp. 457–466 1961.

*Primary Examiner*—Donald Hajec
*Assistant Examiner*—Tan Ho
*Attorney, Agent, or Firm*—Herbert Dubno

[57] ABSTRACT

A window antenna for a motor vehicle body opening in which the antenna is used for mobile radio in a double-band operation with bands have a long wavelength L and a short wavelength K. Two monopoles L/4 and K/4 are electrically connected by a foot portion to which the core of the coaxial feeder cable is adjoined. Two radials corresponding in dimensions to the monopoles can extend along at least one edge of the pane and parallel to the frame member. The radials are connected to the shielding. The spacing of the radials from the frame, the width of the radials and their lengths are selected so that the radiation characteristics are optimized and standing surface waves on the shielding of the cable is avoided.

5 Claims, 3 Drawing Sheets

WINDOW ANTENNA FOR A MOTOR VEHICLE BODY

FIELD OF THE INVENTION

Our present invention relates to an antenna pane, i.e. a window equipped with a window, receivable in a window opening of a metallic vehicle body and which is designed for mobile radio use in a dual-band operation in which a long wavelength L and a short wavelength K differ substantially by a factor of two (i.e. L=2K), the antenna having monopoles whose lengths depend upon or are a function of the wavelengths.

BACKGROUND OF THE INVENTION

Mobile radio operates with electromagnetic waves in the decimeter range. A monopole is a linear antenna trace which can be formed in or on the window pane formed with the antenna and which normally is set into a window frame or is otherwise mounted on the metallic body of the vehicle. The pane itself can be a single pane or a composite pane made up of a laminate, e.g. in the case of safety glass.

The antenna trace can be printed, for example, on the glass and can be built up, if desired, galvanically, or can be incorporated in the glass as a wire trace.

A monopole whose length is a quarter of the wavelength is generally referred to as a quarter lambda monopole and, since the long wavelength with which the present application is concerned has been designed at L and the short wavelength as K, the quarter lambda monopoles thereof will have lengths of L/4 and K/4 respectively and will be referred to as L/4 and K/4 monopoles respectively.

The transmission characteristics and, conversely, the reception characteristics of quarter lambda monopoles are excellent with respect to the wide angle of transmission and reception (high access angle) and are characterized as well by a relatively high vertical access angle. They, therefore, are highly useful for mobile radio and thus in the mobile radio range the use of L/4 and K/4 monopoles is known.

However, with such known antenna panes, the L/4 and K/4 monopoles generally are provided as independent antennas which are not conductively interconnected. They are separately operated. In the case of L wavelength mobile radio, the L/4 monopole is switched into service and for K wavelength mobile radio transmission and reception, the K/4 monopole is used.

The inductive and/or capacitive alternation of the two monopoles does not pose a problem.

The transmission characteristic of a quarter lambda monopole is clearly defined for an arrangement of a quarter lambda monopole above an endless fully conductive surface, generally referred to ground or ground plane and the same applies reciprocally for the receiving characteristic.

In practice, however, where the antenna is a rod and the body of the vehicle functions as a ground plane or ground, it has been found to be desirable to simulate the ground by a radial constituting an antenna element whose length is determined by the wavelength and which is in inductive or capacitive exchange with the vehicle body.

The radials of an antenna on a window pane generally run parallel to a metallic edge of the window opening.

Such systems have been found to be very satisfactory for mobile radio. However, the independent arrangement of two antennas with their respective quarter lambda monopoles requires special treatment in the path from the transmitter to the antenna and from the antenna to the receiver and has created problems with such connections. Problems also have arisen in modern vehicle fabrication techniques where the antenna panes must be automatically mounted in the vehicle body, with respect to the running of the lines between the transmitter and receiver and the window antenna.

For the reception of classical shortwave signals, whose wavelengths are substantially longer than the electromagnetic waves of modern mobile radio, it is known to operate with crossed linear antennas (see British Patent document GB 460 570) whose cross arm to both sides of the crossing point are of different lengths and on one side and the other of the crossover are in resonance with crossing waves of the shortwave spectrum, like lambda half dipoles. They are not, however, separately driven in the sense previously described.

This antenna is not provided with radials of the type mentioned above and the application of the principles of this system to window antennas which are set into motor vehicle bodies and for mobile radio is not described nor does the document contain any teaching as to how the dipoles can be matched to wavelengths which are suitable for mobile radio.

Window antennas for motor vehicles which have monopoles of different lengths for different wavelengths and electronically interconnected are described in Japanese Patent Document JP A 62-43905 and U.S. Pat. No. 4,749,989, without any reference to radials. These antennas are not suitable either for mobile radio in a dual-band operation.

OBJECTS OF THE INVENTION

It is, therefore, the principal object of the present invention to provide an improved window antenna for mobile radio operating in a dual-band range and which is free from drawbacks of earlier systems.

Still another object of our invention is to provide an improved antenna pane, usually in combination with a vehicle body in which the antenna pane is mounted, and which can have an antenna of a relatively simple configuration but satisfying all of the requirements for transmission and reception of signals in mobile radio of the dual-band type.

SUMMARY OF THE INVENTION

These objects and others which will become apparent hereinafter are attained, by the combination of a window pane having an antenna and the metallic body of a motor vehicle in the window opening of which the window is received, the antenna being suitable for dual band operation at two frequencies of wavelengths L and K, respectively, differing by a factor of 2 and whereby L=2K, the antenna comprising:

an L/4 monopole and a K/4 monopole electrically connected in parallel and extending in a U or V pattern away from a common foot portion of the antenna electrically interconnecting the L/4 monopole and K/4 monopole whereby ends of the L/4 monopole and K/4 monopole remote from the foot portion are spaced apart;

an l-radial assigned to the L/4 monopole and a k-radial assigned to the K/4 monopole, the radials extending parallel to the metal frame member;

means for connecting a core wire of a coaxial feeder cable to the common foot portion;

means for connecting a shielding of the coaxial feeder cable to both of the radials, the radials being so spaced from the metal frame member, being of such widths, and having respective lengths l and k such that an outer surface of the cable is substantially free from surface standing waves.

The radials are so spaced from the metal frame member, are of such width and have lengths such that the radiation characteristics are optimized.

The length of the k radial is matched to the length of the K/4 monopole and the length of the l radial is matched to the length of the L/4 radial. The l radial, in the case of a U pattern of the monopoles, is normally at the same side as the L/4 monopole while the k radial is at the same side as the K/4 monopole. It is also possible according to the invention to provide the l radial at the side of the K/4 monopole and the k radial at the L/4 side.

The shield of the coaxial cable at the side electronic equipment (transmitter/receiver) can be connected to the component ground and with the vehicle body.

The invention utilizes the consideration that a circular opening in an endlessly extending perfectly conducting plane itself can function as an antenna (i.e. the so-called generalized Babinet principle, cf. Sommerfeld, *OPTIK*, 1964, pages 177–179). This "hole antenna" has in its plane a singular structure of the electrical or magnetic field strengths when the ratio of the wavelengths of the electromagnetic waves and the diameter of the opening lies in a singular diffraction range as is usually the case for mobile radio waves and for conventional motor vehicle antenna disks (*Handbuch der Physik*, Vol. XXV/1, 1961, pages 460–465). That these considerations require modification in the case of a window opening of a motor vehicle body has not, however, been recognized heretofore.

The invention is based upon the recognition that the monopoles (L-monopole and K-monopole) in the "hole antenna" which is formed by the window opening of the vehicle body should be matched to the structure of the electromagnetic field strengths and that a special coupling to the "ground" formed by the vehicle body is required.

This is achieved, in accordance with the invention, with the combination described above and wherein the spacing of the two radials from the metal edge of the window opening as well as the lengths of the two radials and their widths are so selected that the shielding of the coaxial antenna feeder cable is practically free from standing surface waves and the radiation characteristics are optimized.

Surprisingly this also allows the antenna to be matched to the impedance of the cable or vice versa. This matching or optimization can readily be effected with simple tests. The same applies also to the overall orientation of the monopoles and the radials in the window opening.

The two monopoles of an antenna pane (window antenna) of the present invention, surprisingly, do not have an negative or injurious effect upon a window antenna as a whole. With a window antenna of the present invention, the two monopoles are connected in parallel. The longer monopole is resonant in the longer wavelength band (low ohmic) and the shorter monopole is, for that band, to short and thus capacitively high ohmic. As a consequence the shorter monopole is functionless for the long wavelength opetration. For operation within the shorter wavelength band, the longer monopole is too long and therefore high ohmic. In other words, in each frequency band only a respective one of the monopoles is resonant.

By the parallel connection with the resonant shorter monopole as well as the special arrangement described of the radials matched in length and width, the overall configuration is adapted to the dual band mobile radio operation.

It should be understood that the monopoles can also be provided with capacitative foreshortening, if desired, in accordance with the invention and as is known in the antenna art.

This can be achieved especially with reference to the longer monopoles in a simple manner, namely by choosing a T-shaped configuration therefor.

It should be understood further that the references to L/4 monopole and K/4 monopole in the sense of the antenna art is to be understood and the length tolerances to be understood as encompassing ±20% of the particular wavelength. The geometric length of the monopole is reduced from the vacuum or air quarter wavelength because of the presence of the dielectric glass pane upon which the antenna is applied. The shortening factor is dependent upon the window opening and thus upon the geometry of the antenna pane, upon the geometry of the monopole and, above all, upon the thickness of the glass pane which is used. The shortening factor is typically 0.6 to 0.8.

In one preferred embodiment of the invention, in addition to the first-mentioned L/4 monopole, a second L/4 monopole is provided and the two L/4 monopoles diverge in a V pattern from the foot portion while the K/4 monopole extends along the axis of the V.

Conversely we can provide a configuration in which two K/4 monopoles diverge in a V pattern while the L/4 monopole extends along the axis of the V.

The invention also encompasses an embodiment with a U pattern of the L/4 monopoles which can be disposed symmetrically with reference to the K/4 monopoles, the free ends of the L/4 monopoles being electrically conductively interconnected.

The optimization described above can be achieved simply and is especially pronounced with the l radial and the k radial corresponding in length to that of the respective monopoles. However the l radial and the k radial can have lengths which are $(2n-1)$ times the length of the respective monopoles where n is an integer greater than or equal to one.

Where the monopoles are arranged in a U pattern, optimization can be readily obtained when the space 1 of the monopoles of the U corresponds substantially to K/20 or less and the radials have a width of at least K/200, and a preferred width is K/100.

The radials, can, moreover be doubled, i.e. can consist each of two parallel traces.

For conventional polarization of the electromagnetic waves in mobile radio, it has been found to be most advantageous to arrange the monopoles so that they are substantially vertical.

Correspondingly, the radials are preferably horizontally oriented. In an embodiment in which the window antenna is a windshield, the radials can be oriented along the upper edge of the windshield so that the monopoles extend downwardly. This is also the preferred orientation for a rear window of the vehicle.

In an embodiment in which the window antenna forms a side window of the vehicle, the radials can be oriented along the upper and/or lower edge so that the monopoles reach toward the opposite edge. For an embodiment in which a triangular window is provided, the radials preferably lie along the lower edge and extend upwardly.

BRIEF DESCRIPTION OF THE DRAWING

The above and other object, features and advantages of the present invention will become more readily apparent from the following description, reference being made to the accompanying drawing in which.

Figure 1:
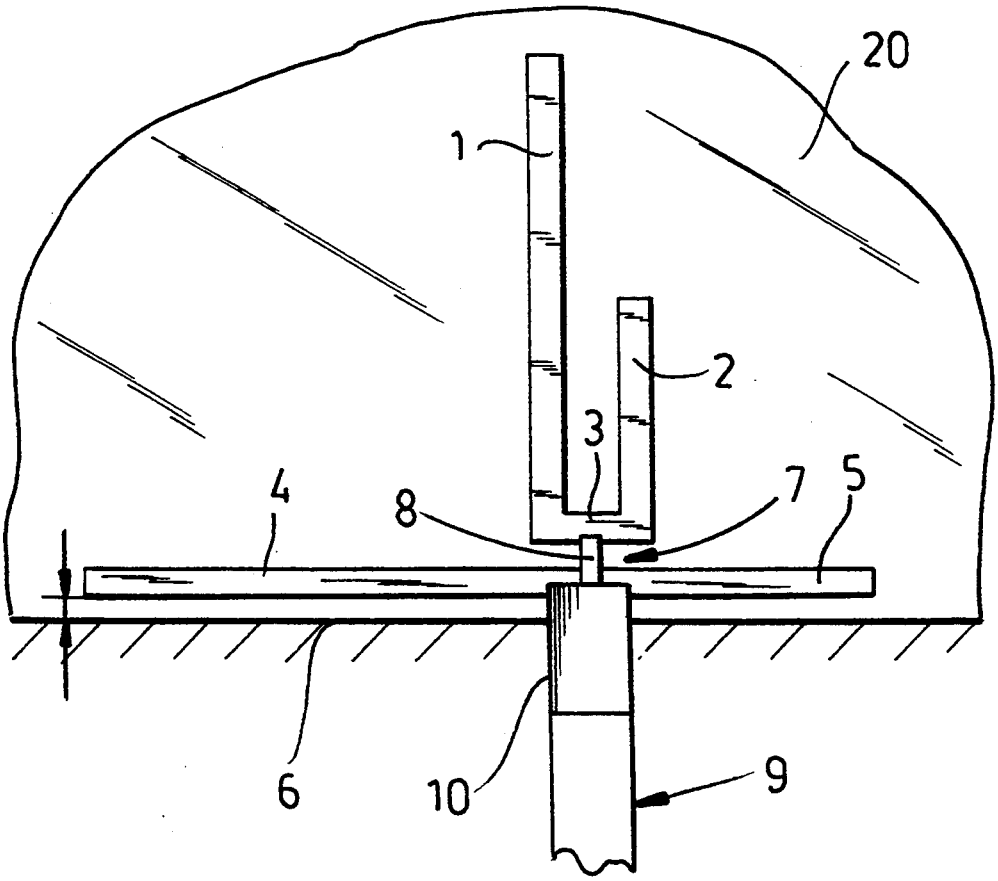
FIG. 1 is an elevational view of a window antenna in a diagrammatically illustrated vehicle window opening according to the invention.
Figure 2A:
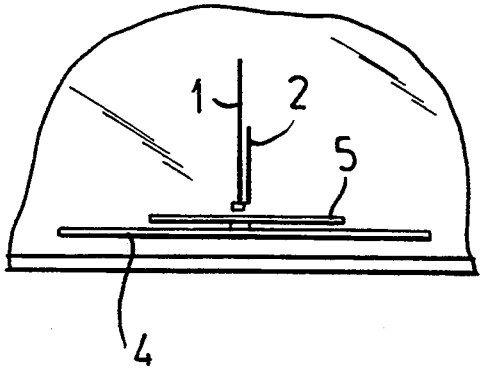
Figure 2B:
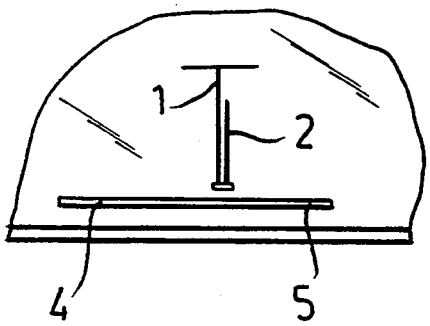
Figure 2C:
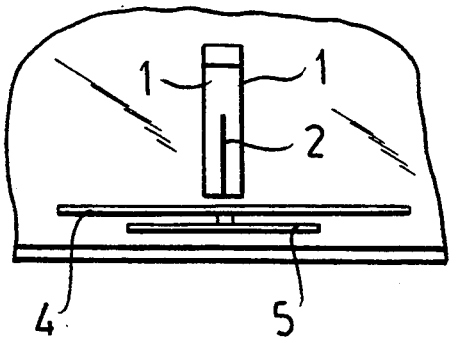
Figure 2D:
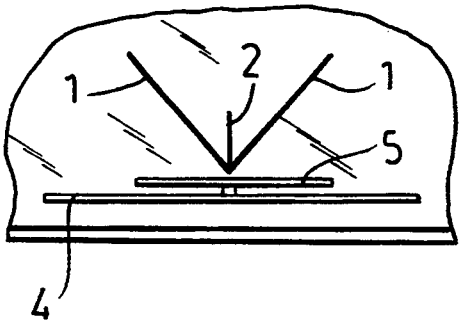
Figure 2E:
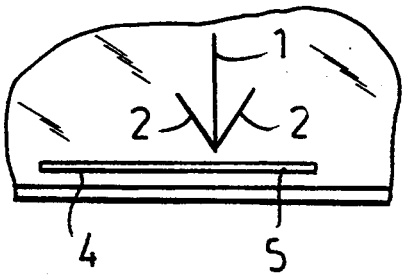
Figure 2F:
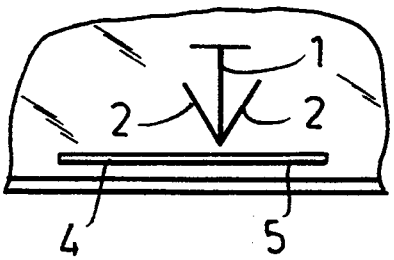
Figure 3A:
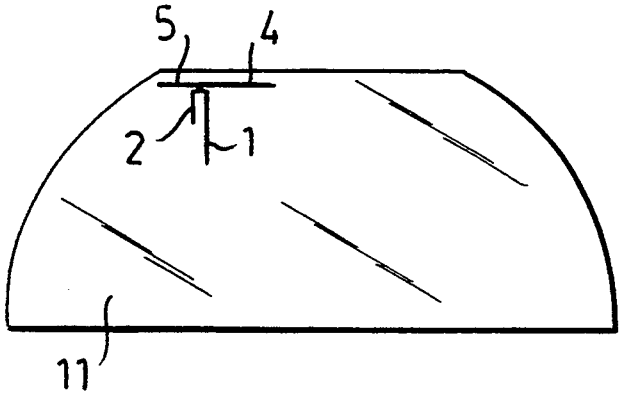
Figure 3B:
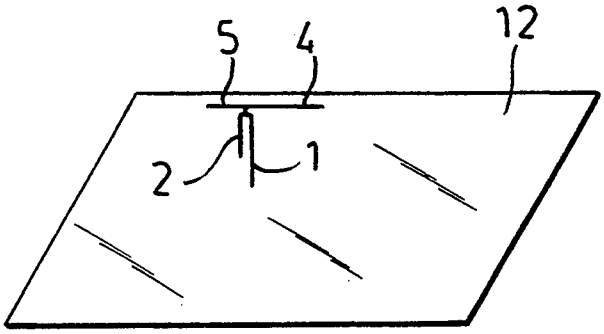
Figure 3C:
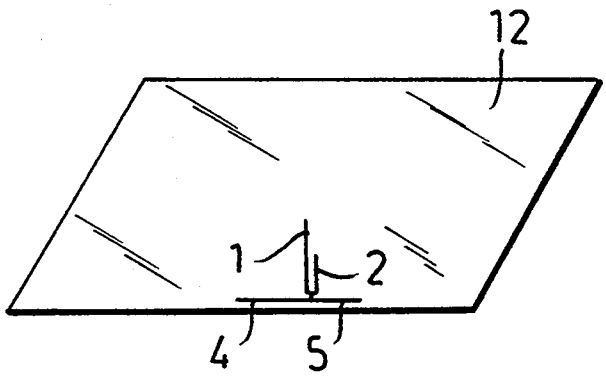
Figure 3D:
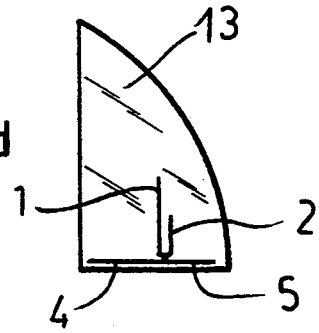

FIGS. *2a–2f* show particular configurations of the monopoles and radials of antennas according to the invention without, however, illustrating the connection of the coaxial cable thereto; and FIGS. *3a–3d* show other window antenna configurations of the invention.

SPECIFIC DESCRIPTION

The antenna panes or window antennas shown in the drawing are intended to be received in window openings of a metallic motor vehicle body and, in each illustrated case, the frame can be considered to be the solid line surrounding the glass pane.

The pane has been shown as planar in all of the Figures but it will be understood that curved window antennas can also be used. The window antenna panes of the invention are intended for use in mobile radio in a dual-band operation where the wavelengths L and K are different by a factor of two, i.e. L=2K. The antennas on the panes are formed from monopoles whose lengths are determined by the wavelengths of the bands.

In the drawing, and in FIGS. 1, *2a–2f* and FIGS. *3a–3d*, the antenna comprises on a pane 20 (FIG. 1) and on corresponding panes of the remaining Figures, always at least one L/4 monopole 1 as well as at least one K/4 monopole 2 electrically connected in parallel and in a U pattern or a V pattern with the electrical connection being made at a foot portion 3.

The L/4 monopole 1 is associated with the l radial 4 while the K/4 monopole 2 is associated with a k radial 5, the radials 4 and 5 extending parallel to the metallic edge or frame member 6 of the window opening.

The l radial 4 is located at the side of the L/4 monopole 1 while the k radial 5 is located toward the side of the K/4 monopole 2. The reverse orientation can also be used.

The feeder cable has a coaxial cable 9 whose core wire 8 is connected to the foot portion 3 by a solder connection or other means represented diagrammatically at 7. The shielding 10 of the coaxial cable is connected with the two radials 4, 5. In general, the connection 7 may be made a solder joint, a plug and jack connection or the like as long as the impedance of the connection 7 corresponds to the impedance of the coaxial cable 9.

As the double arrow in FIG. 1 shows, the spacing of the two radials 4, 5 from the metallic edge 6 of the window openings, as well as the lengths and breadths of the radials are so selected that the shielding or jacket 10 of the coaxial cable is practically free from standing surface waves and the radiation characteristic is optimized.

From FIG. *2d*, it will be apparent that an additional L/4 monopole 1 can be provided so that the two monopoles 1 are in a V pattern with the K/4 monopole 2 extending along the axis of the V.

FIGS. *2e* and *2f* show a reverse orientation in which the V pattern is formed by two K/4 monopoles and the L/4 monopole 1 extends along the V axis.

In both FIGS. *2b* and *2f*, the L/4 monopole has a T configuration with the cross bar of the T being provided at the free end of the L/4 monopole, thereby capacitively shortening the L/4 monopole.

FIG. *2c* shows a system in which the additional L/4 monopole forms a U pattern with the L/4 monopoles being parallel to one another and symmetrically disposed with respect to the K/4 monopole 2. The ends of the L/4 monopoles 1 are here connected.

FIGS. *2a* and *2b* show parallel L/4 and K/4 monopoles similar to the configuration of FIG. 1 but with the radials 4 and 5 doubled in FIG. *2a* and of the same orientation as that of FIG. 1 in FIG. *2b*. Doubled radials 4 and 5 are also apparent from FIGS. *2c* and *2d*.

The orientations of the monopoles 1, 2 and radials 4, 5 will be apparent from FIGS. *3a–3d*. In the case of windshield or rear window 11 (FIG. *3a*), the radials 4 and 5 are located along the upper edge and extend downwardly.

For side windows 12 (FIGS. *3b* and *3c*), the radials 4 and 5 can be located along the upper or lower edge respectively with the monopoles 1, 2 extending toward the opposite edge.

For a triangular window 13 like the side window of FIG. *3d*, the radials 4 and 5 extend along the lower edge with the monopoles 1 and 2 extending vertically upwardly. When the monopoles 1, 2 are located at a corner of the window pane, the radials 4 and 5 can also include an angle less than 180° so that they can be parallel to the frame and pane edges which adjoin at that corner.

We claim:

1. In a window opening of a motor vehicle having a metallic body, the combination therewith of a window pane having adjacent a metal frame member of said body, a mobile radio antenna on said pane for dual band operation at two frequencies of wavelengths L and K, respectively, differing by a factor of 2 and whereby L=2K, said antenna comprising:

an L/4 monopole and a K/4 monopole electrically connected in parallel and extending in a U or V pattern away from a common foot portion of the antenna electrically interconnecting the L/4 monopole and K/4 monopole whereby ends of said L/4 monopole and K/4 monopole remote from said foot portion are spaced apart, only a respective one of said monopoles being resonant at each of said frequencies;

an l-radial assigned to said L/4 monopole and a k-radial assigned to said K/4 monopole, said radials extending parallel to said metal frame member;

means for connecting a core wire of a coaxial feeder cable to said common foot portion;

means for connecting a shielding of said coaxial feeder cable to both of said radials, said radials being so spaced from said metal frame member, being of such widths, and having respective lengths l and k optimizing the radiation characteristics and such that an outer surface of said cable is substantially free from surface standing waves, said antenna comprising a further L/4 monopole parallel to the first-mentioned L/4 monopole and forming a U pattern therewith and with said foot portion which electrically interconnects both of said L/4 monopoles, said L/4 monopoles being disposed symmetrically with respect to said K/4 monopole.

2. In a window opening of a motor vehicle having a metallic body, the combination therewith of a window pane having adjacent a metal frame member of said body, a mobile radio antenna on said pane for dual band operation at two frequencies of wavelengths L and K, respectively, differing by a factor of 2 and whereby L=2K, said antenna comprising:

an L/4 monopole and a K/4 monopole electrically connected in parallel and extending in a U or V pattern away from a common foot portion of the antenna electrically interconnecting the L/4 monopole and K/4 monopole whereby ends of said L/4 monopole and K/4 monopole remote from said foot portion are spaced apart, only a respective one of said monopoles being resonant at each of said frequencies;

an l-radial assigned to said L/4 monopole and a k-radial assigned to said K/4 monopole, said radials extending parallel to said metal frame member;

means for connecting a core wire of a coaxial feeder cable to said common foot portion;

means for connecting a shielding of said coaxial feeder cable to both of said radials, said radials being so spaced from said metal frame member, being of such widths, and having respective lengths l and k optimizing the radiation characteristics and such that an outer surface of said cable is substantially free from surface standing waves, said l radial having the same length as said L/4 monopole and said k radial having substantially the same length as said K/4 monopole.

3. In a window opening of a motor vehicle having a metallic body, the combination therewith of a window pane having adjacent a metal frame member of said body, a mobile radio antenna on said pane for dual band operation at two frequencies of wavelengths L and K, respectively, differing by a factor of 2 and whereby L=2K, said antenna comprising:

an L/4 monopole and a K/4 monopole electrically connected in parallel and extending in a U or V pattern away from a common foot portion of the antenna electrically interconnecting the L/4 monopole and K/4 monopole whereby ends of said L/4 monopole and K/4 monopole remote from said foot portion are spaced apart, only a respective one of said monopoles being resonant at each of said frequencies;

an l-radial assigned to said L/4 monopole and a k-radial assigned to said K/4 monopole, said radials extending parallel to said metal frame member;

means for connecting a core wire of a coaxial feeder cable to said common foot portion;

means for connecting a shielding of said coaxial feeder cable to both of said radials, said radials being so spaced from said metal frame member, being of such widths, and having respective lengths l and k optimizing the radiation characteristics and such that an outer surface of said cable is substantially free from surface standing waves, each of said l radial and said k radial having a length which is (2n−1) times the length of the respective monopole associated therewith, n being a whole number at least equal to one.

4. In a window opening of a motor vehicle having a metallic body, the combination therewith of a window pane having adjacent a metal frame member of said body, a mobile radio antenna on said pane for dual band operation at two frequencies of wavelengths L and K, respectively, differing by a factor of 2 and whereby L=2K, said antenna comprising:

an L/4 monopole and a K/4 monopole electrically connected in parallel and extending in a U pattern away from a common foot portion of the antenna electrically interconnecting the L/4 monopole and K/4 monopole whereby ends of said L/4 monopole and K/4 monopole remote from said foot portion are spaced apart, only a respective one of said monopoles being resonant at each of said frequencies;

an l-radial assigned to said L/4 monopole and a k-radial assigned to said K/4 monopole, said radials extending parallel to said metal frame member;

means for connecting a core wire of a coaxial feeder cable to said common foot portion;

means for connecting a shielding of said coaxial feeder cable to both of said radials, said radials being so spaced from said metal frame member, being of such widths, and having respective lengths l and k optimizing the radiation characteristics and such that an outer surface of said cable is substantially free from surface standing waves, a spacing between said monopoles being at most K/20.

5. In a window opening of a motor vehicle having a metallic body, the combination therewith of a window pane having adjacent a metal frame member of said body, a mobile radio antenna on said pane for dual band operation at two frequencies of wavelengths L and K, respectively, differing by a factor of 2 and whereby n=2K, said antenna comprising:

an L/4 monopole and a K/4 monopole electrically connected in parallel and extending in a U or V pattern away from a common foot portion of the antenna electrically interconnecting the L/4 monopole and K/4 monopole whereby ends of said L/4 monopole and K/4 monopole remote from said foot portion are spaced apart, only a respective one of said monopoles being resonant at each of said frequencies;

an l-radial assigned to said L/4 monopole and a k-radial assigned to said K/4 monopole, said radials extending parallel to said metal frame member;

means for connecting a core wire of a coaxial feeder cable to said common foot portion;

means for connecting a shielding of said coaxial feeder cable to both of said radials, said radials being so spaced from said metal frame member, being of such widths, and having respective lengths l and k optimizing the radiation characteristics and such that an outer surface of said cable is substantially free from surface standing waves, said radials being doubled.

* * * * *